US005363521A

United States Patent [19]

Garland et al.

[11] Patent Number: 5,363,521

[45] Date of Patent: Nov. 15, 1994

[54] COLLAPSIBLE PLAYPEN

[75] Inventors: Thomas A. Garland, Jamestown, R.I.; Robert A. Kolich, East Aurora, N.Y.; Charles W. Paddock, Lancaster, N.Y.; James P. Bicheler, Alden, N.Y.

[73] Assignee: Fisher-Price, Inc., East Aurora, N.Y.

[21] Appl. No.: 998,370

[22] Filed: Dec. 30, 1992

Related U.S. Application Data

[63] Continuation-in-part of Ser. No. 891,854, Jun. 1, 1992, abandoned.

[51] Int. Cl.[5] ..... A47D 7/00; A47D 13/06

[52] U.S. Cl. ..... 5/99.1; 5/98.1

[58] Field of Search ..... 5/99.1, 98.1, 98.2; 256/25

[56] References Cited

U.S. PATENT DOCUMENTS

| | | | |
|---|---|---|---|
| D. 192,072 | 1/1962 | Hamilton . | |
| D. 193,326 | 8/1962 | Hamilton . | |
| D. 257,299 | 10/1980 | Cone . | |
| D. 304,523 | 11/1989 | Dillner et al. | 5/99.1 |
| D. 323,589 | 2/1992 | Mariol . | |
| 1,374,333 | 4/1921 | Stotler et al. | 5/98.3 |
| 1,413,068 | 4/1922 | Stotler et al. | 5/98.3 |
| 2,254,939 | 9/1941 | Elias | 5/99.1 |
| 2,464,866 | 3/1949 | Holtz | 5/99.1 |
| 2,486,054 | 10/1949 | Morse | 5/99.1 |
| 2,489,188 | 11/1949 | Landry | 5/99.1 |
| 2,498,203 | 2/1950 | Fischer | 5/99.1 |
| 2,523,124 | 9/1950 | Landry | 5/99.1 |
| 2,561,637 | 7/1951 | Rex | 5/99.1 |
| 2,569,937 | 10/1951 | Lindgren | 5/99.1 |
| 2,617,999 | 11/1952 | Mitchell | 5/99.1 |
| 2,624,054 | 1/1953 | Plant | 5/99.1 |
| 2,659,903 | 11/1953 | Hagelfeldt | 5/99.1 |
| 2,675,565 | 4/1954 | Froelich | 5/99.1 |
| 2,688,756 | 9/1954 | Carlson | 5/99.1 |
| 2,710,976 | 6/1955 | Martensen | 5/98.1 |
| 2,733,453 | 2/1956 | Cifarelli | 5/99.1 |
| 2,769,183 | 11/1956 | Froelich | 5/99.1 |
| 2,781,527 | 2/1957 | Landry | 5/99.1 |
| 2,784,420 | 3/1957 | Moltane | 5/98.1 |
| 2,814,051 | 11/1957 | Lee et al. | 5/99.1 |
| 2,825,071 | 3/1958 | Landry et al. | 5/99.1 |
| 2,851,701 | 9/1958 | Lukala | 5/99.1 |
| 2,901,755 | 9/1959 | Wood, Jr. | 5/99.1 |
| 2,908,021 | 10/1959 | Fulton | 5/99.1 |
| 2,922,169 | 1/1960 | Werner | 5/98.1 |
| 3,018,493 | 1/1962 | Wittbrodt | 5/99.1 |
| 3,040,341 | 6/1962 | Hesketh et al. | 5/99.1 |
| 3,063,065 | 11/1962 | Shaw | 5/99.1 |
| 3,064,277 | 11/1962 | Gill | 5/98.1 |
| 3,092,847 | 6/1963 | De Puy | 5/99.1 |
| 3,095,583 | 7/1963 | Golub et al. | 5/99.1 |
| 3,103,670 | 9/1963 | Landry | 5/99.1 |
| 3,119,124 | 1/1964 | Krauss | 5/99.1 |
| 3,127,620 | 4/1964 | Peterson | 5/99.1 |
| 3,158,876 | 12/1964 | Gottlieb | 5/99.1 |
| 3,163,870 | 1/1965 | Scotney, III | 5/99.1 |
| 3,165,760 | 1/1965 | Abajian | 5/99.1 |
| 3,183,528 | 5/1965 | Jacobs et al. | 5/99.1 |
| 3,187,352 | 6/1965 | Gottlieb | 5/99.1 |
| 3,206,772 | 9/1965 | Sarasin | 5/99.1 |
| 3,206,773 | 9/1965 | Sarasin | 5/99.1 |
| 3,233,254 | 2/1966 | Golub et al. | 5/99.1 |
| 3,309,718 | 3/1967 | Sarasin | 5/98.1 |
| 3,430,273 | 3/1969 | Stillwaugh | 5/98.1 |
| 3,474,472 | 10/1969 | Hamilton, II | 5/98.1 |

(List continued on next page.)

FOREIGN PATENT DOCUMENTS

| | | |
|---|---|---|
| 1557841 | 2/1969 | France . |
| 2361846 | 3/1978 | France . |

*Primary Examiner*—Alexander Grosz
*Attorney, Agent, or Firm*—Howrey & Simon

[57] ABSTRACT

A collapsible playpen having a pair of spaced apart articulated end frames, wherein the end frames are separated by articulated upper and lower rails. The end frames and rails are constructed so that the playpen is collapsed by folding the lower rails to draw lower portions of the end frames together and simultaneously rotating the upper portion of the opposing end frames away from each other such that the distance between the upper portion of the end frames is greater than the distance between the lower portion of the end frames.

26 Claims, 8 Drawing Sheets

U.S. PATENT DOCUMENTS

| | | | |
|---|---|---|---|
| 3,606,620 | 9/1971 | Glover | 5/99.1 |
| 3,789,439 | 2/1974 | Berg et al. | 5/99.1 |
| 3,800,341 | 4/1974 | Davanzo | 5/99.1 |
| 3,801,208 | 4/1974 | Bourgraf et al. | 403/102 |
| 3,886,607 | 6/1975 | Dunn | 5/99.1 |
| 3,924,280 | 12/1975 | Vaiano | 5/99.1 |
| 4,008,499 | 2/1977 | Wren, Jr. et al. | 5/99.1 |
| 4,069,524 | 1/1978 | Carlo | 5/99.1 |
| 4,070,716 | 1/1978 | Satt et al. | 5/99.1 |
| 4,186,454 | 2/1980 | Cone | 5/99.1 |
| 4,202,065 | 5/1980 | Sullivan | 5/99.1 |
| 4,304,017 | 12/1981 | Mortimer | 5/99.1 |
| 4,357,735 | 11/1982 | Saint et al. | 5/99.1 |
| 4,376,318 | 3/1983 | Cirillo | 5/99.1 |
| 4,455,697 | 6/1984 | Rovida | 5/99.1 |
| 4,493,120 | 1/1985 | Watts | 5/99.1 |
| 4,532,674 | 8/1985 | Tobey et al. | 16/295 |
| 4,561,138 | 12/1985 | Hwang | 5/99.1 |
| 4,573,224 | 3/1986 | Saint | 5/99.1 |
| 4,635,305 | 1/1987 | Wyss | 5/99.1 |
| 4,651,367 | 3/1987 | Osher et al. | 5/99.1 |
| 4,669,138 | 6/1987 | Kassai | 5/99.1 |
| 4,683,600 | 8/1987 | Beger | 5/99.1 |
| 4,688,280 | 8/1987 | Kohus et al. | 5/99.1 |
| 4,692,953 | 9/1987 | Fetters | 5/99.1 |
| 4,702,719 | 10/1987 | Lapid | 16/374 |
| 4,703,525 | 11/1987 | Shamie | 5/99.1 |
| 4,710,049 | 12/1987 | Chang | 5/99.1 |
| 4,811,437 | 3/1989 | Dillner et al. | 5/99.1 |
| 4,819,285 | 4/1989 | Fetters | 5/99.2 |
| 4,837,875 | 6/1989 | Shamie et al. | 5/99.1 |
| 4,934,025 | 6/1990 | Mariol | 5/99.1 |
| 5,214,716 | 9/1993 | Kohus | 5/99.1 |

COLLAPSIBLE PLAYPEN

This is a continuation-in-part of copending application Ser. No. 07/891,854 filed on Jun. 1, 1992, now abandoned. The present invention relates to playpens, and more particularly, to a readily collapsible playpen movable between a collapsed and an open position.

BACKGROUND OF THE INVENTION

U.S. Pat. No. 4,376,318 to Cirillo discloses a portable playpen wherein the foldable playpen includes upper and lower retaining frames separated by vertical members. The end or side of the vertical structure members fold inwardly and released vertical members to provide a compact arrangement for carrying.

U.S. Pat. No. 4,837,875 to Shamie et al. discloses a folding playpen with attached fabric enclosure. A playpen includes a frame having floor supports with inner ends which are connected to each other by a hub that permits swinging of the floor supports in a horizontal plane from an in use position to a folded position. The uprights are connected by hinges to the outer ends of the floor supports. Bendable sides and end rails interconnect the tops and bottoms of the uprights. One of the cross-members can be removed whereas provided with a mechanism to permit its elongation, such that the frame can be folded with all other parts permanently connected to each other and without removing the fabric enclosure.

U.S. Pat. No. 4,070,716 to Satt et al. discloses a foldable playpen having two end portions and two side portions which are interconnected to form a substantially square frame. The two end portions are pivotal in a downward direction toward a center vertical leg located at each end and the side portions are pivotal inward bringing the two folded end portions together, to thereby fold the playpen.

SUMMARY OF THE INVENTION

The present invention provides a foldable playpen having a novel construction for permitting easy folding of the playpen.

Specifically, the present playpen includes a first end assembly and a second end assembly, wherein each end assembly includes an end base for contacting a support surface and an upright frame. The upright frame of each end assembly includes articulated uprights which extend upward from the end base and terminate at an upper cross bar, wherein the articulated uprights selectively space the upper cross bar from the base of the end assembly.

An embodiment of the present playpen also includes lower articulated rails extending between the end bases for disposing the end bases in a parallel spaced apart orientation in the open position and a parallel adjacent orientation in the collapsed position.

The collapsible playpen further includes upper articulated rails extending between the upper cross bars of each end assembly, wherein the upper articulated rails permit rotation of the upper cross bars relative to the corresponding end base, while the upper cross bars remain parallel to each other and the corresponding end base.

The articulated uprights and the upper and lower articulated rails are adapted to orient the upper cross bar and the end base within each end assembly in a spaced apart parallel orientation in the operative position and an adjacent parallel orientation in the collapsed position, wherein the distance between the parallel upper cross bars is greater than the distance between the parallel end bases in the collapsed position in the playpen.

DETAILED DESCRIPTION OF THE PREFERRED EMBODIMENT

Figure 1:
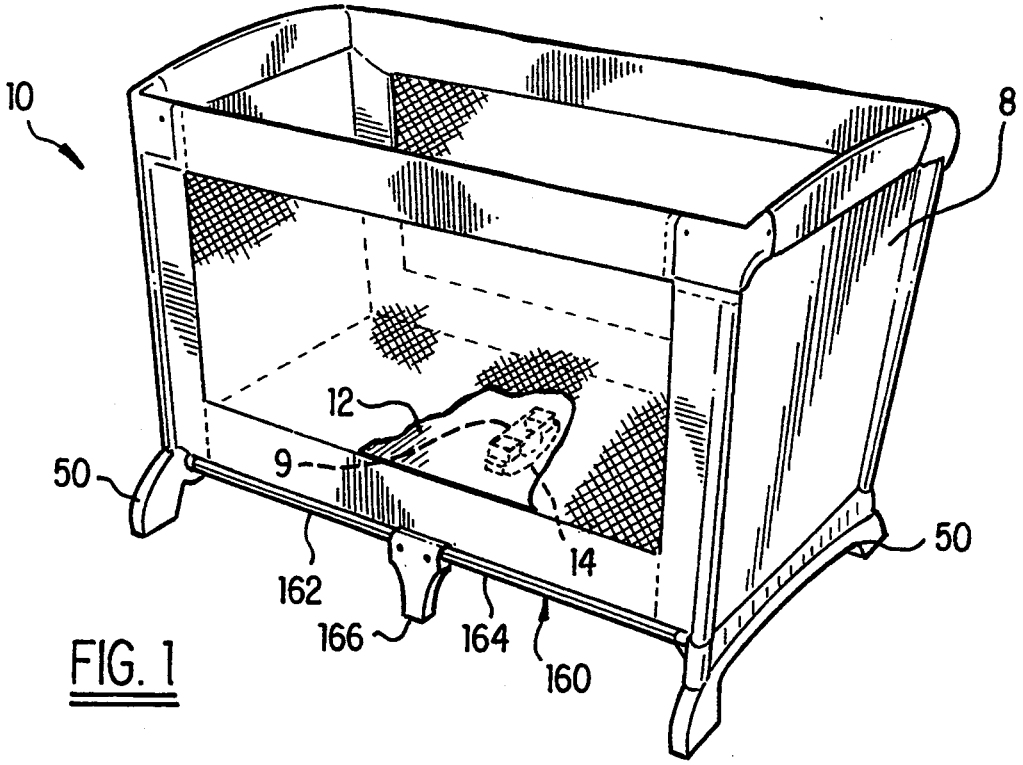
FIG. 1 is a perspective view of the present invention in the open configuration position.
Figure 2:
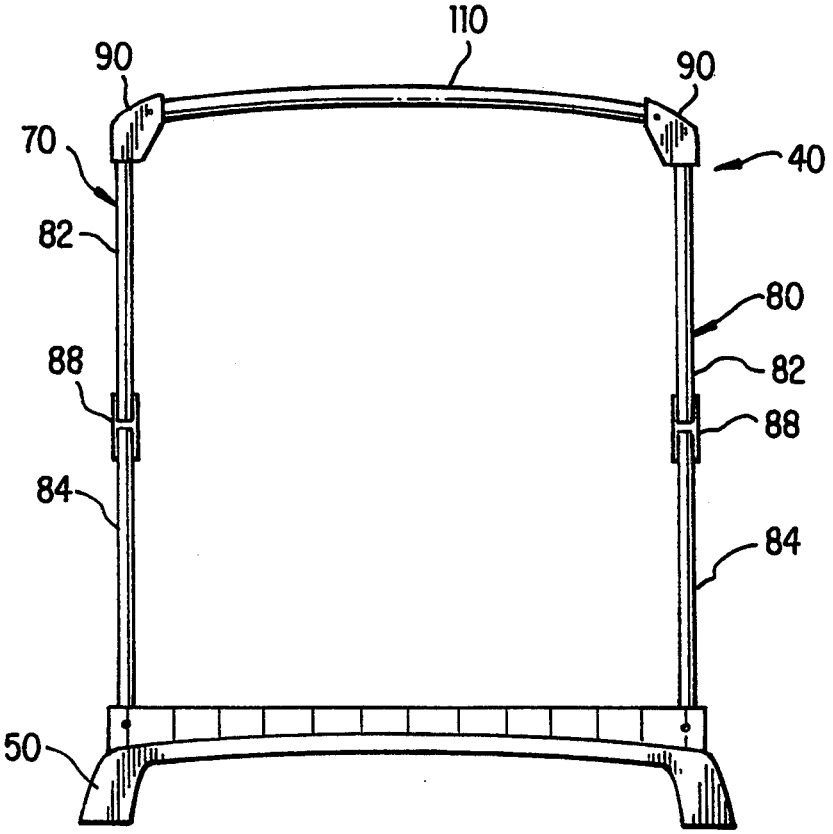
FIG. 2 is an end view of the collapsible frame of the present invention in open configuration.
Figure 3:
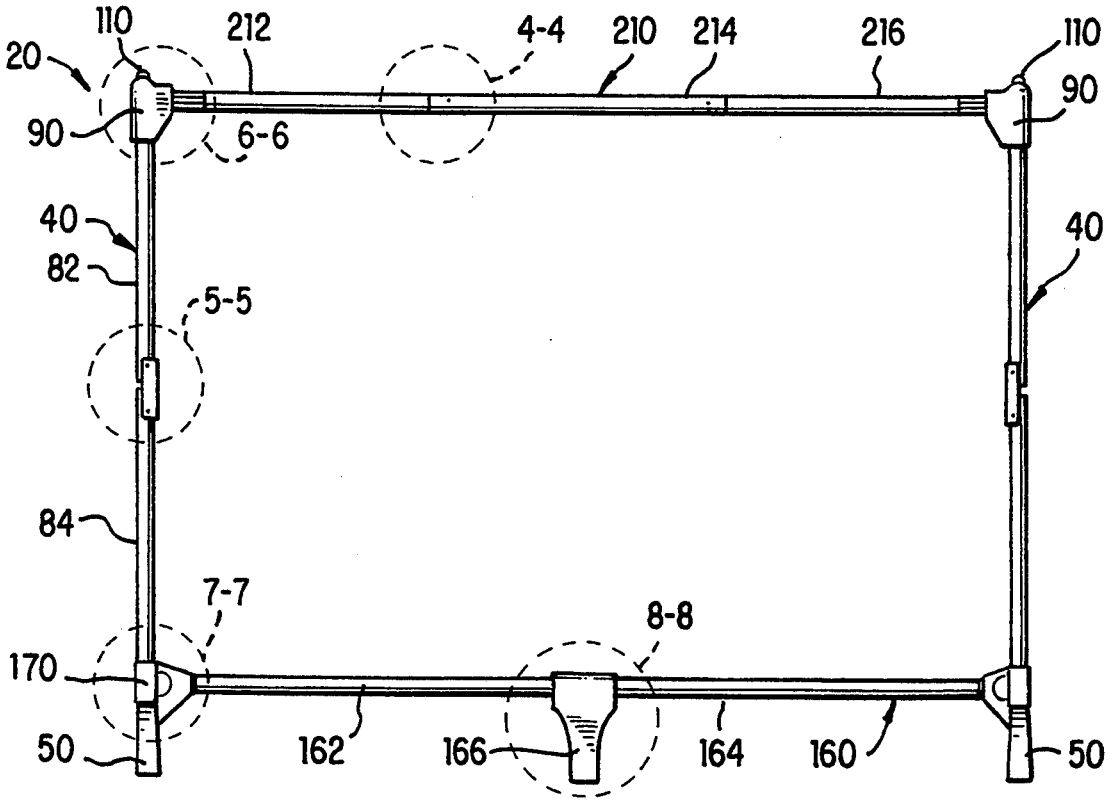
FIG. 3 is a side elevational view showing the frame of the present invention in the open configuration.

Referring to FIGS. 1–3, the playpen 10 of the present invention is shown in an open, operative position. The playpen 10 includes a fabric enclosure 8 cooperatively engaged to a frame 20. The fabric enclosure 8 defines an operative volume of the playpen for occupancy by a child. The fabric enclosure 8 has mesh side walls and solid, or opaque, end walls and floor.

Referring to FIGS. 1–3, the frame 20 includes a first and second end assembly 40. The end assemblies 40 define an operative volume 30 intermediate of the end assemblies. Each end assembly, 40 includes an end base 50 for contacting a support surface, a collapsible upright end frame 70 and an upper cross bar 110. The end bases 50 of the end assemblies 40 are parallel to each other and connected by a pair of lower articulated rails 160. The upper cross bars 110 of the end assemblies 40 are interconnected by a pair of upper articulated rails 210.

As shown in FIG. 1, 3, 7 and 8, each lower articulated rail 160 includes a pair of rail sections 162,164 and a central coupler 166. One end of each rail section 162,164 is pivotally attached to the central coupler 166. The remaining ends of the rail sections 162,164 are connected to opposing end bases 50. The connection between the rail section 162,164 and the end base 50 provides for pivoting of the rail section relative to the base and rotation of the rail section about its longitudinal axis.

Figure 7A:
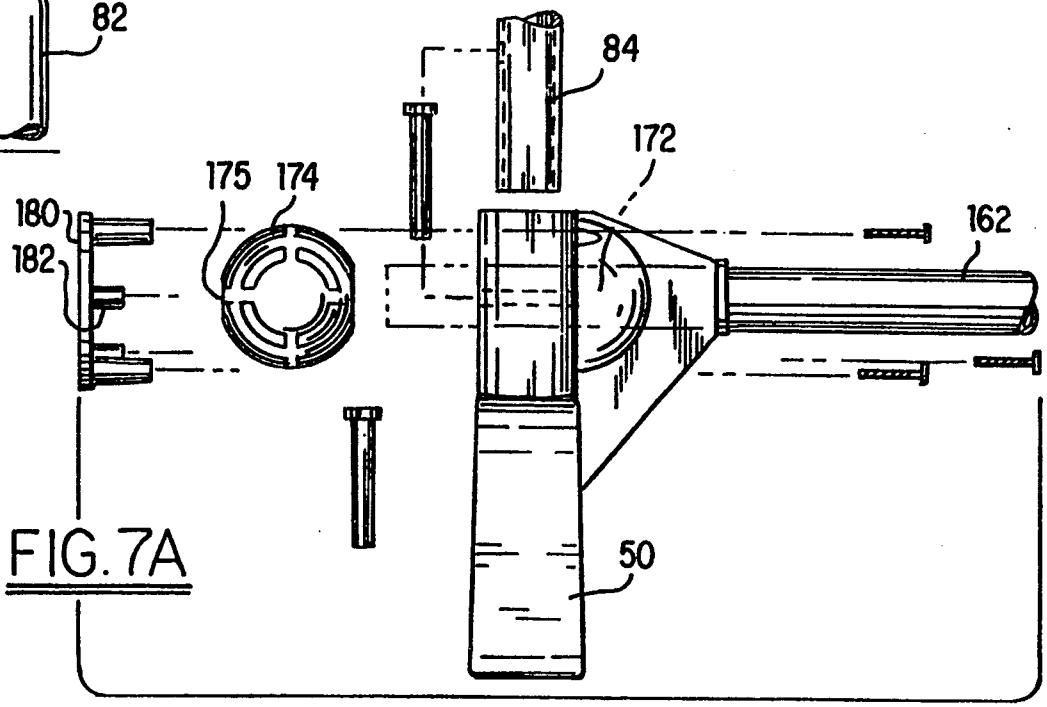
FIGS. 7, 7*a*, 7*b* and 7*c* are enlarged views of the joint indicated by lines 7—7 of FIG. 3.
Figure 7:
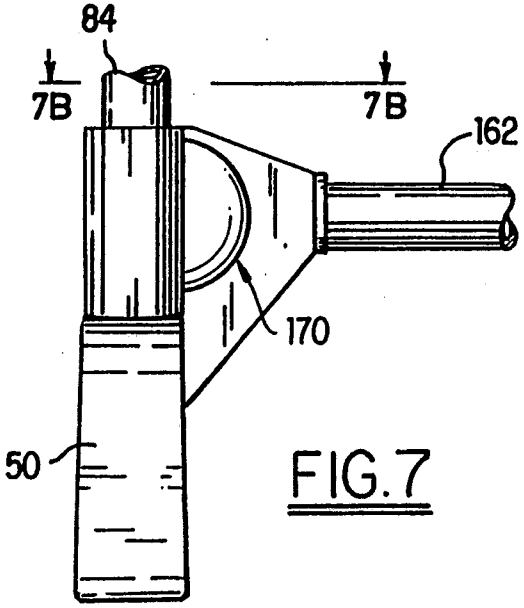
Figure 7B:
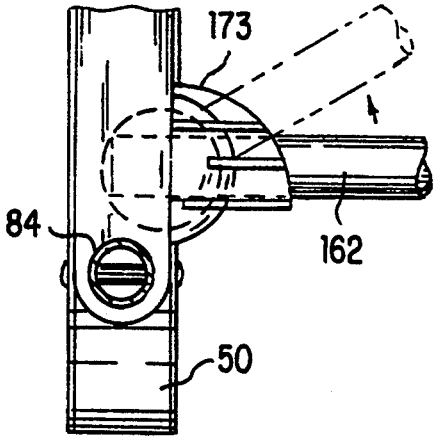
Figure 7C:
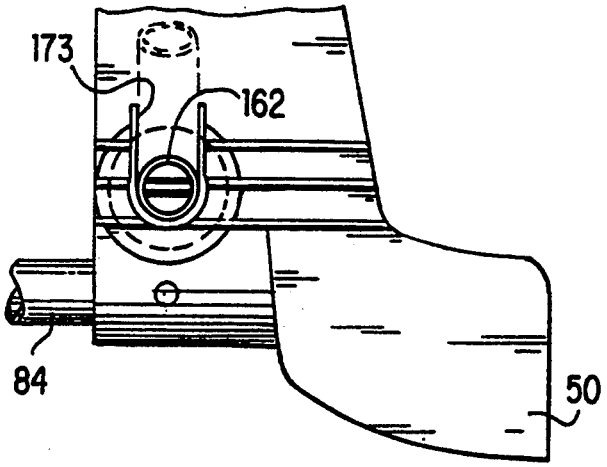

Referring to FIGS. 7—7*c*, the connection of the lower articulated rail 160 to the end base 50 generally employs a ball and socket joint 170. The base includes a socket 172 having a radial slot 173 sized to receive a portion of the rail section 162,164. The end of the rail section extends through the slot 173 and is fixedly attached to a ball 174. The ball 174 is retained with the socket 172 by a retaining plate 180 on the outside of the end base. 50. The retaining plate 180 may be glued, screwed or welded to the end base 50 to capture the ball 174 within the socket 172. The ball 174 includes a generally T-shaped groove 175 in the outer surface of the ball. The retaining plate 180 includes an elongated tab 182 sized to be received within the groove 175. The groove 175 and the tab 182 are configured so that upon orientation of the central coupler 166 as shown in FIGS. 1, 3 and 8, the ball 174 cannot pivot within the socket 172, and upon rotation of the coupler 166 as shown in FIGS. 8*c* and 8*d*, the rail sections 162,164 rotate about their longitudinal axis and the tab 182 aligns with the length of the T groove 175 to permit pivoting of the ball 174 within the socket 172 as the tab slides along the groove.

The outer ends of each rail section 162,164 are thereby rotatably and pivotally affixed to an end base 50. The rail sections 162,164 may pivot from the open position perpendicular to the end base 50 to the collapsed position parallel to the end base.

Figure 8A:
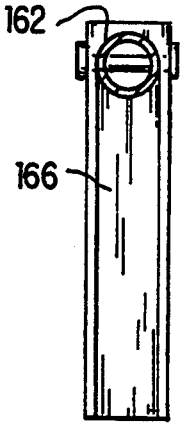
FIGS. 8, 8*a*, 8*b*, 8*c* and 8*d* are enlarged views of, and show the relative motion of the two-way coupling indicated by lines 8—8 of FIG. 3.
Figure 8:
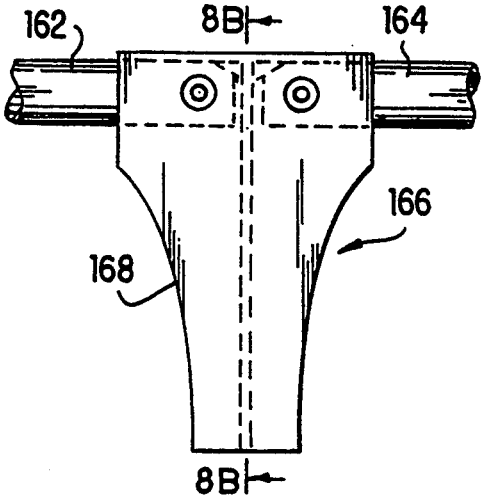
Figure 8B:
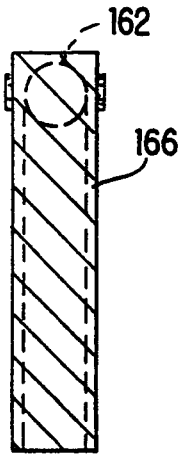
Figure 8C:
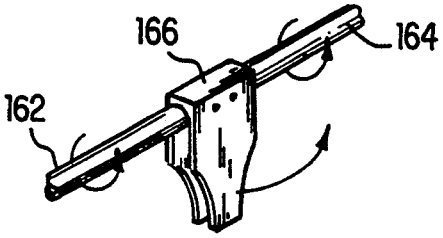
Figure 8D:
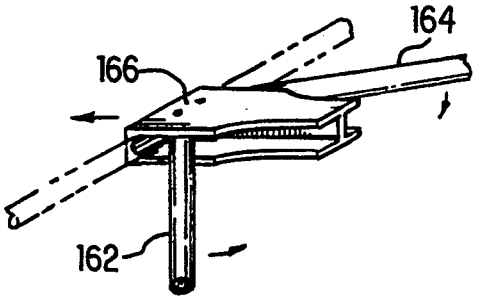

As shown in FIGS. 8 and 8*d*, the inner end of each rail section 162,164 is pivotally attached to the central coupler 166. The central coupler 166 includes a depending portion 168 for contacting the supporting surface while retaining the rail sections 162,164 in a substantially horizontal orientation. The rail sections 162,164 are pivotally attached to the central coupler 166 to pivot about an axis transverse to the length of the rail section. Therefore, as the central longitudinal axis coupler 166 is rotated about an axis which is transverse to the pivot axis between the rail sections 162,164 and the coupler, the rail sections rotate about their longitudinal axis. The attachment to the central coupler 166 permits pivoting of the rail sections relative to the central coupler. The central coupler 166 may rotate the rail sections 162,164 about their longitudinal axis, then permit pivoting of the rail section relative to the central coupler.

The rail sections 162,164 rotate about their longitudinal axis with respect to the end base 50, as the depending portion 168 of the central coupler 166 is rotated from the support surface. The rail sections rotate about their longitudinal axis, thereby aligning the tab 182 and the T-groove 173 to permit pivoting of the rail section relative to the end base.

Referring to FIGS. 2, 3, 5 and 5A, a collapsible upright end frame 70 extends upward from each end base 50 to support the upper cross bar 110. The upright end frame 70 includes a collapsible upright 80 extending from each end of the end base 50 to the ends of the upper cross bar 110. Each upright 80 includes an upper and lower upright section, 82 and 84 respectively, and a one-way hinge 88. The upper cross bar 110 extends between the tops of the collapsible uprights 80 and is fixedly attached thereto. Preferably, the intersection of the cross bar 110 and the uprights 80 includes a bracket 90.

The end assembly 40 may be described as having a lower portion including the end base 50 and lower upright sections 84, and an upper end portion which includes the upper upright sections 82 and the cross bar 110. That is although depicted as separate components, the end base 50 and lower upright 84 may form a single lower end portion of the end assembly.

As shown in FIGS. 7 and 7A, the bottom of each lower upright section 84 is fixedly attached to the end base 50 and extends vertically from the end base. The top of the lower upright section 84 is pivotally attached to the hinge 88. The hinge 88 is an elongated U-shaped member sized to receive the diameter of the upright sections 82,84 between the legs of the hinge. The bottom of the upper upright section 82 is also pivotally attached to the hinge 88. As shown in FIGS. 2, 3, 5 and 5*a*, the closed portion of the hinge 88 is disposed towards the opposing end assembly 40. Therefore, as the upper upright sections 82 within each end assembly 40 rotate about the hinge 88, the upper upright sections 82 initially rotate away from the opposing end assembly. While the cross bars 110 rotate away, the cross bars do not move away from each other. That is, the absolute distance between the cross bars does not increase upon rotation of the cross bars 110 about hinges 88. The hinges 88 permit folding of the articulated uprights 80 about the hinge by rotating the upper upright sections 82 away from the plane of the opposing end assembly 40. The upper upright sections 82 within a given end assembly 40 are fixedly connected to the upper cross bar 110 and include the brackets 90, and folding about the hinges 88 permits the upper cross bar 110 to initially rotate in a direction away from the opposing end assembly 40.

Figure 6A:
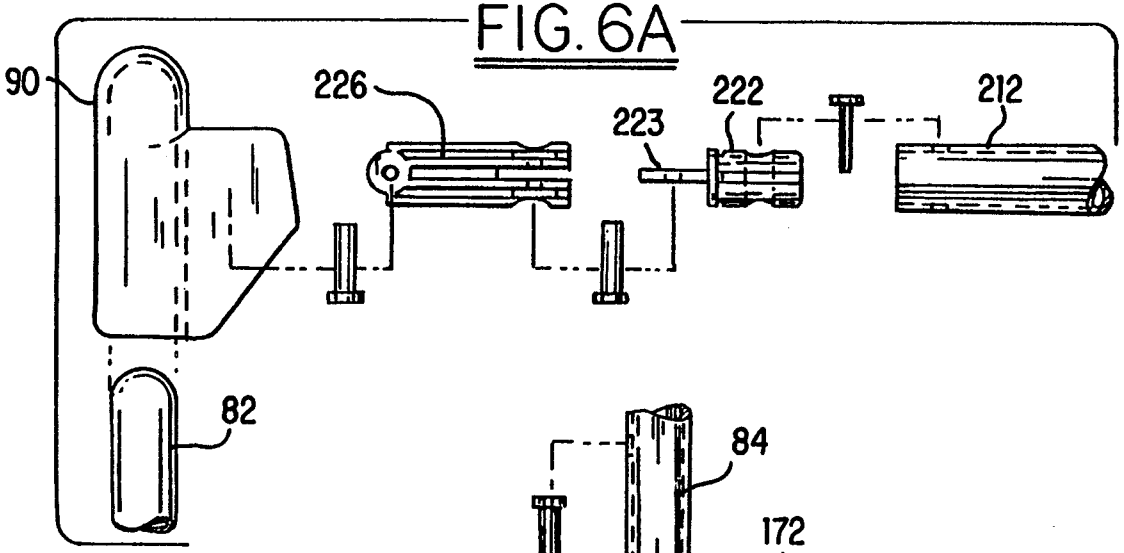
FIGS. 6 and 6*a* are enlarged views of the joint indicated by lines 6—6 of FIG. 3.
Figure 6:
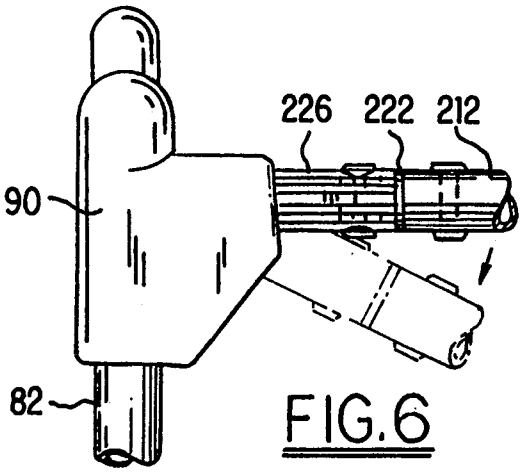

Referring to FIGS. 2, 3 and 6, the corner bracket 90 allows for interconnection of the upright 80, the upper cross bar 110 and the upper articulated rails 210.

The upper articulated rails 210 extend between the upper cross bars 110 of the opposing end assemblies 40 to form collapsible side rails. As shown in FIG. 3, each upper rail 210 has three segments, including two outer segments 212,216 and an intermediate segment 214. The outer end of each outer segment 212,216 is pivotally attached to a corner bracket 90 to permit rotation of the end segment towards the upper upright section 82 of the corresponding upright 80 and towards the corresponding upper cross bar 110.

Referring to FIG. 6 and 6*a*, the outer segments 212,216 bi-directionally rotate relative to the corner brackets 90. The outer ends of the outer segments 212,216 are fixedly attached to a first blade 222. The first blade 222 includes an aperture 223. The first blade 222 is pivotally connected to a second blade 226, such that the second blade is perpendicular to the first blade. The second blade 226 is pivotally attached to the corner bracket 90 about an axis which is substantially parallel to the length of the upper cross bar 110. Therefore, the outer segment 212,216 may be rotated downward towards the corresponding upper upright section 82, or horizontally towards the corresponding upper cross bar 110.

Figure 4:
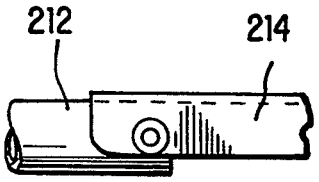
FIGS. 4 and 4*a* are enlarged views of the coupling indicated by lines 4—4 in FIG. 3.
Figure 4A:
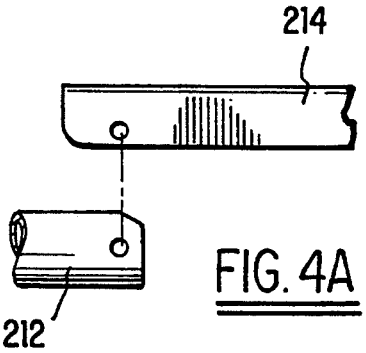
Figure 5:
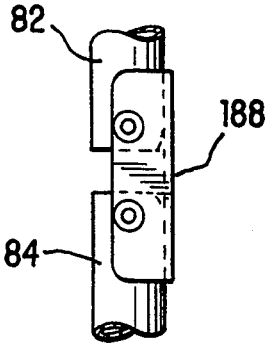
FIGS. 5 and 5*a* are enlarged views of the coupling indicated by lines 5—5 in FIG. 3.
Figure 5A:
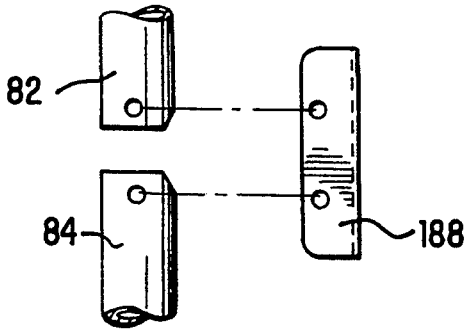

Referring to FIGS. 4 and 4*a*, the remaining end of each outer segment 212,216 is pivotally connected to the intermediate segment 214. The intermediate segment 214 is a substantially U-shaped member sized to receive the diameter of the outer segments 212,216 within the U. The closed portion of the U shape is disposed upwards, such that the outer segments 212,216 may pivot downwards with respect to the intermediate segment 214. The intermediate segments 214 permit folding of the outer segments 212,216 about the intermediate segment to permit rotation about an axis parallel to the upper cross bars 110, or ends of the playpen 10.

In the open position, the supporting end bases 50 are spaced apart in a parallel orientation. The lower articulated rails 160 extend between the end bases 50 and are substantially perpendicular to the end bases. The central couplers 166 are oriented such that the depending portion 168 contacts the supporting surface. The rail sections 162,164 within each lower articulated rail 160 are colinear. The lower articulated rails 160 and end bases 50 form a rectangular periphery.

In the open position of the playpen 10, the uprights 80 in each end assembly orient the upper cross bar 110 above and parallel to the end base 50. The upper and lower sections 82,84 within of each upright 80 are colinear, such that all uprights of the playpen are parallel and vertical.

The upper articulated rails 210 extend between the upper cross bars 110 of each end assembly 40 such that the outer sections 212,216 and intermediate section 214 of each upper articulated rail are colinear, and the upper articulated rails are parallel to each other and perpendicular to the upper cross bar. The upper rails 210 cannot be rotated downward as such rotation would require rotation in a direction which is precluded by the hinges in the uprights 80. That is, the interconnection of all the joints are self-locking in the open position of the playpen 10. Similarly with the playpen 10 in the open position, upright 80 cannot fold about hinge 88 as such motion in such direction is precluded by the lower articulated rails 160 and opposing end assembly 40 which retain the end bases 50 in the spaced apart relationship.

The fabric enclosure 8 encloses five of the six sides of the rectangle defined by the collapsible frame 20. The fabric enclosure 8 includes sleeves for surrounding each upright 80 between the end base 50 and the corner bracket 90; each upper cross bar 110; and each upper articulated rail 210. The fabric enclosure 8 does not surround the lower articulated rails 160 or the end bases 50. The bottom of the fabric enclosure includes a central aperture 9.

In the open position, a mat 12 is disposed within the bottom of the fabric enclosure 8 to substantially define bottom periphery of the playpen 10. The mat 12 includes a depending handle 14 sized to pass through the aperture 9 in the bottom of the fabric enclosure 8. The engagement of the handle 14 in the central aperture 9 retains the mat 12 with respect to the fabric enclosure and prevents the mat from sliding relative to the bottom of the enclosure.

In a preferred embodiment, each of the lower rail sections 162,164 has a length of approximately 17 inches, and the central coupler 166 has a length of approximately 3". The lower upright section 84 extends upward to terminate approximately 10" from the end base 50. The hinge 88 has an effective length of approximately two inches, and the upper upright section 82 extends for a length of approximately 13 inches. Each of the outer segments 212,216 of the upper articulated rail extends approximately 13.5" from the corner bracket 90. The intermediate segment has an effective length of approximately 10". The end bases 50 and upper cross bars 110 define a width of approximately 24".

To collapse the playpen 10, the mat 12 is removed from the bottom of the fabric enclosure 8. The collapsing of the playpen is shown schematically in FIGS. 9–12 wherein the reference numbers are indicated by prime accents. That is, central coupler 166 is referred to in FIGS. 9–12 as central coupler 166'.

The locking mechanism, described infra is released and the central couplers 166' of the lower articulated rails 160' are rotated so as to rotate the rail sections 162' 164' about their longitudinal axes. As the rail sections 162',164' rotate about their longitudinal axis, the T-groove 175 in the ball 174 is realigned with respect to the tab 182 on the retaining plate 180, thereby permitting pivoting of each rail section 162',164' relative to the respective end base 50'. That is, after rotation of the central coupler 166', the couplers are pushed towards each other so as to decrease the distance between the parallel end bases 50' as shown in FIGS. 10–12.

Figure 9:
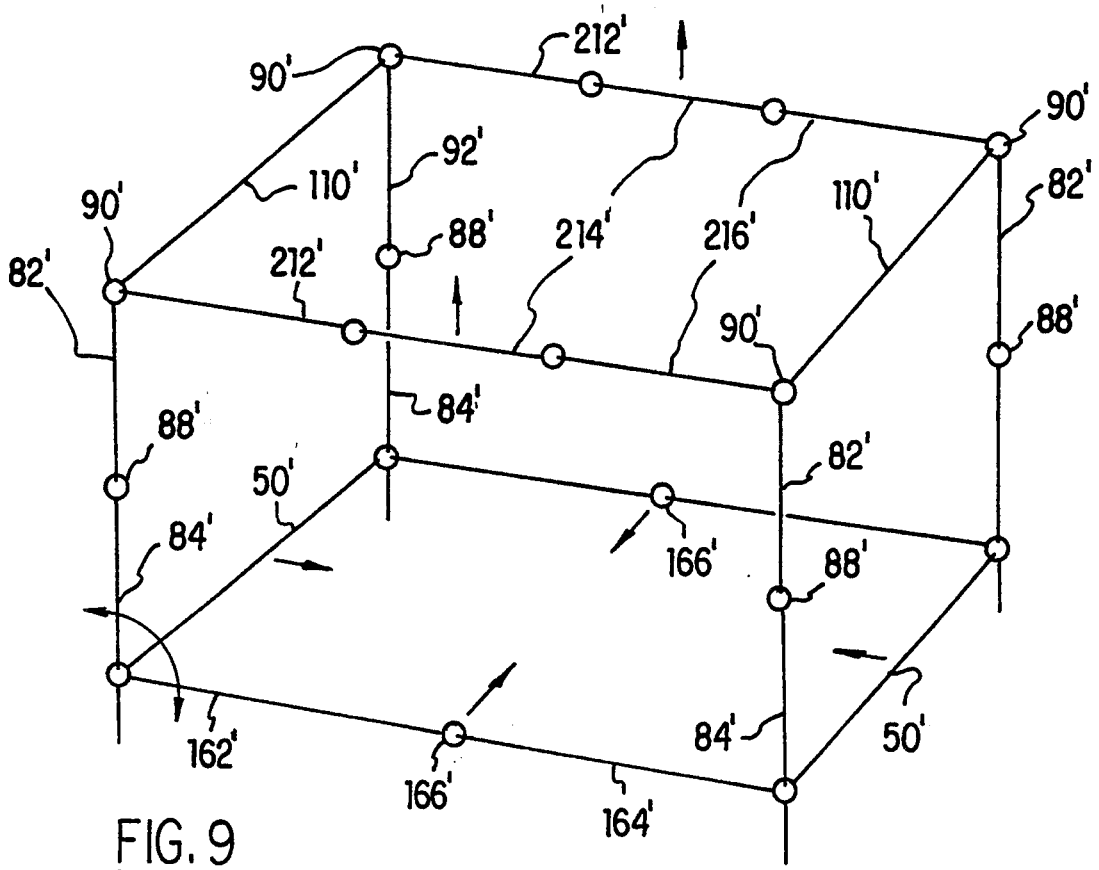
FIG. 9 is a schematic view of the collapsible frame in the erect position.
Figure 10:
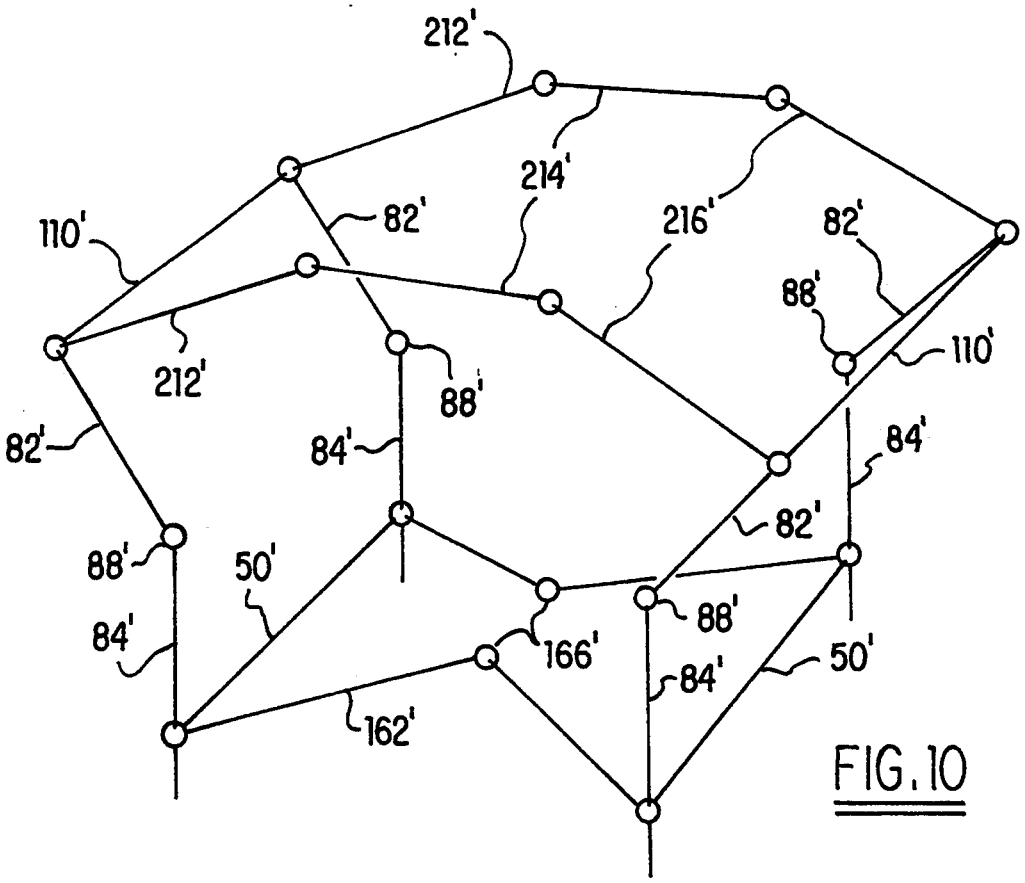
FIG. 10 is a schematic view of the collapsible frame in a partially collapsed position.

Referring to FIGS. 9 and 10, as the distance between the end bases 50' decreases, the absolute distance between the upper portions of the end assemblies also decreases. However, the distance between the end bases 50' decreases more than distance between the upper cross bars 110'.

The outer segments 212',216' of the upper articulated rails pivot towards corresponding upper upright sections 82'. As the distance between the end bases 50' decreases more than the distance between the upper cross bars 110', the upper cross bars are rotated away from each other. The rotation of the upper cross bars 110' is permitted by the folding of the outer segments 212',216' about the intermediate segment 214' and the folding of the upper upright section 82' about the hinge 88'.

Figure 11:
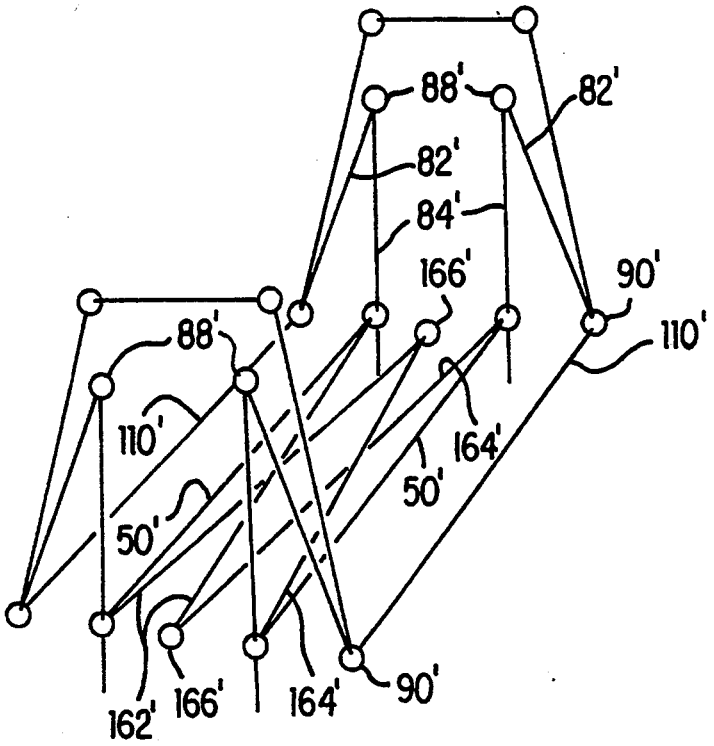
FIG. 11 is a schematic view of the collapsible frame, in substantially collapsed position.
Figure 12:
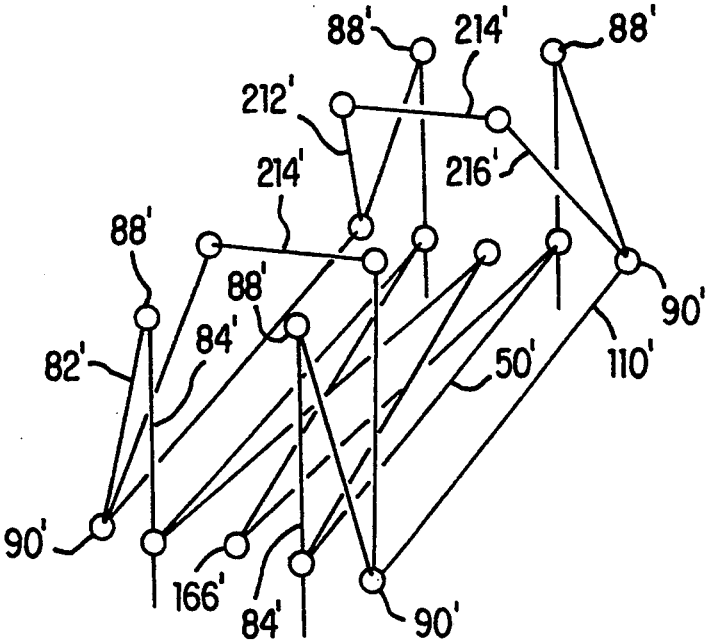
FIG. 12 is a schematic view of the collapsible frame in its completely collapsed position.
Figure 13:
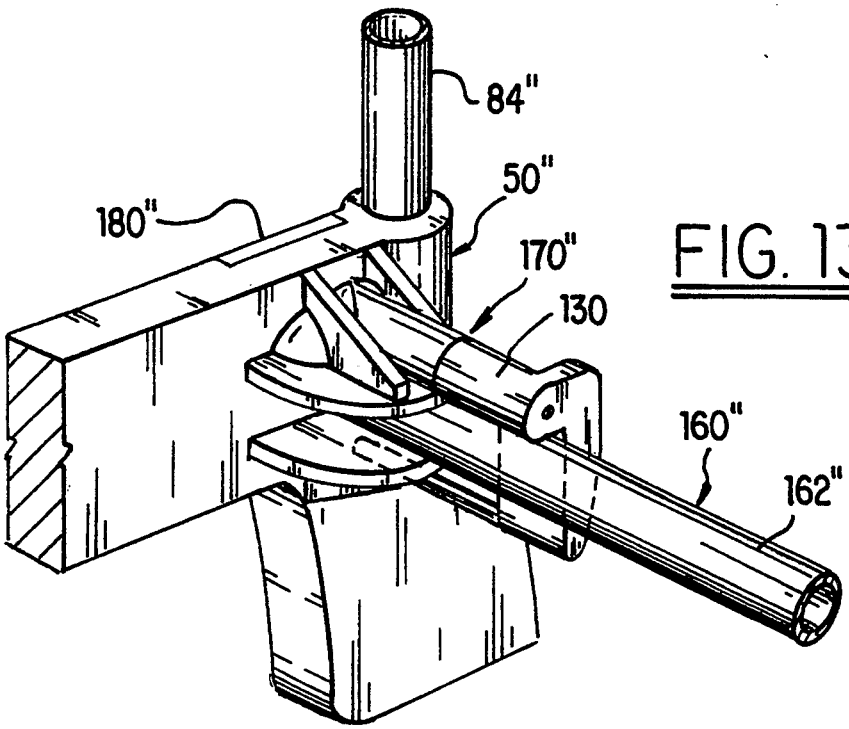
FIG. 13 is a perspective view of the locking mechanism in the open position.

Referring to FIGS. 10 and 11, as the end bases 50' are further drawn together, the central couplers 166' of each lower articulated rail approach the opposing side of the playpen. That is, as shown in FIGS. 10 and 11 the rail sections 162',164' within each lower articulated rail approach a parallel orientation. As the end bases 50' are drawn adjacent to each other, the upper cross bars 110' continue pivoting about the hinge 88' to be disposed outside of, and adjacent their respective end base 50.

As the end bases 50' are drawn together, the upper end portions are initially rotated away from each other to be separated by a distance greater than the distance between the end bases.

Finally, referring to FIG. 12, the intermediate segments 214' of the upper articulated rails may be rotated towards each other. To permit this rotation the bi-directional pivot of the outer segments relative to the corner bracket 90 permits the intermediate sections 214' to be disposed towards each other while remaining in a parallel orientation.

The present construction provides a playpen 10 which is self supporting in the operative position. However, as the occupant of the playpen may outweigh the playpen 10 itself, it may be desirous to include a releasable latch or locking mechanism 130 for retaining the playpen in the operative position. The locking mechanism 130 may cooperate with the playpen 10 in a variety of configurations. Referring to FIGS. 13–16, for example, the locking mechanism may be incorporated into the ball and socket joint 170, or the uprights 80.

The description of the locking mechanism 130 will include components corresponding to those previously described. Therefore, the corresponding components will be designated by double primes (″). Application of the locking mechanism 130 in the ball and socket joint 170″ cooperates with the lower articulated rail 160″ and the end base 50″. The retaining plate 180″ includes the projecting tab 182″ which is colinear with the lower articulated rail 160″ in the operative position.

Figure 14:
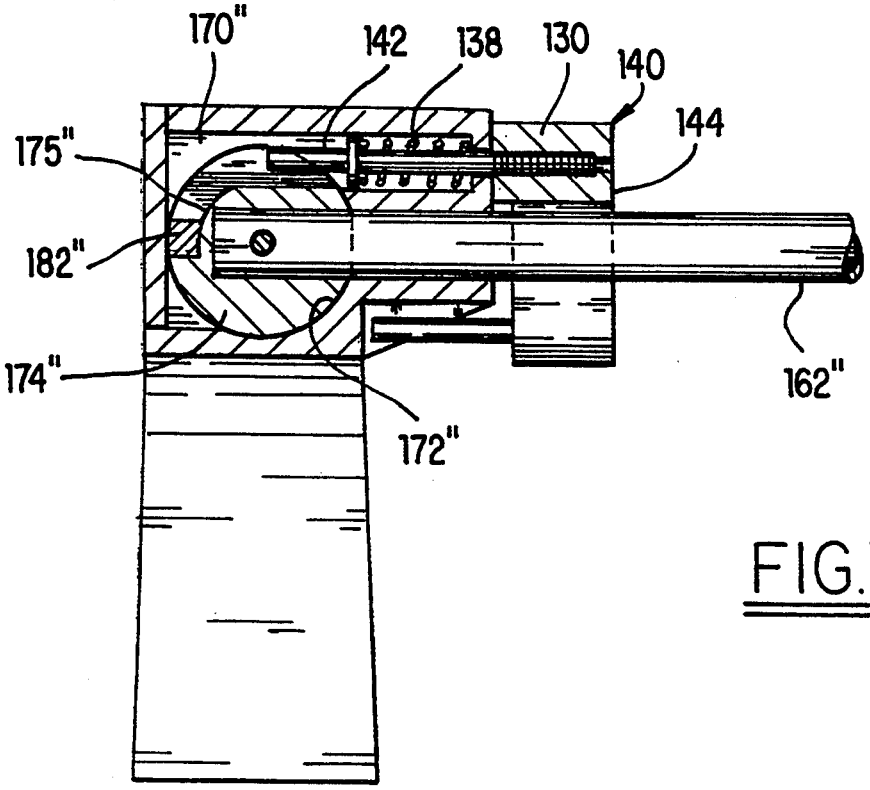
FIG. 14 is a side elevational partial cross sectional view of the locking mechanism in the open position.
Figure 15:
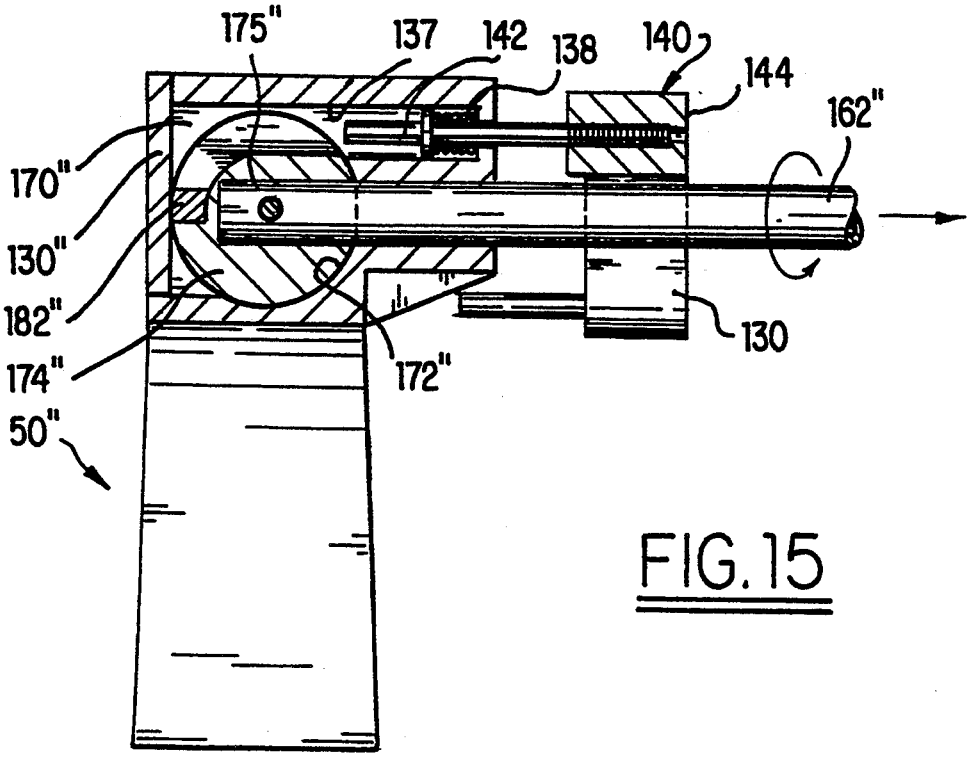
FIG. 15 is a side elevational partial cross sectional view showing the locking mechanism in a release position.
Figure 16:
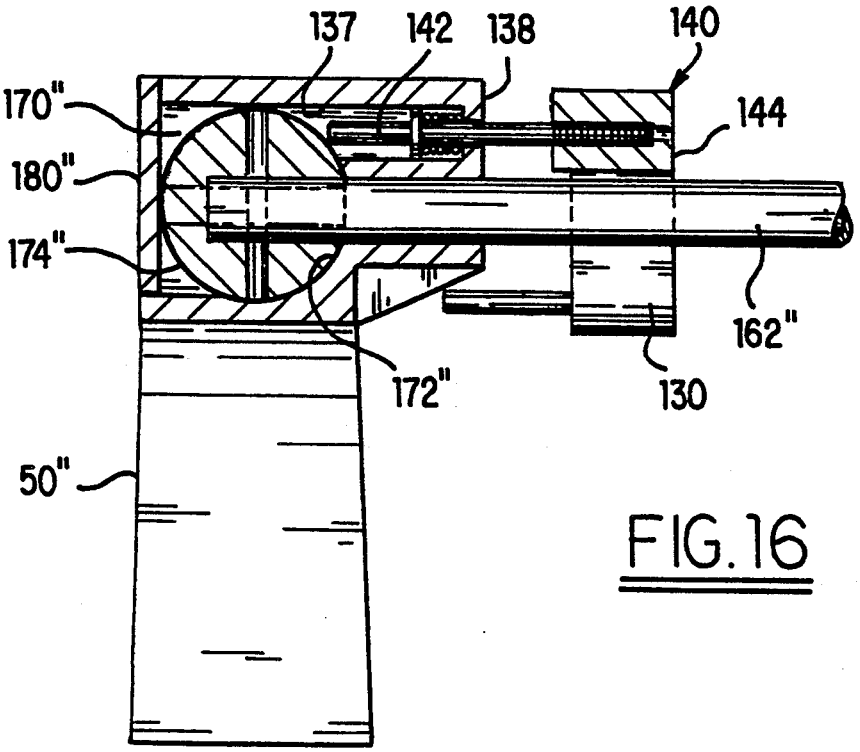
FIG. 16 is a side elevational cross sectional view showing the locking mechanism in the release position after rotation of a rail section.

As shown in FIGS. 14–16, the ball 174″ includes a peripheral groove 175″ sized to slidably receive the tab 182″. The base 50″ includes a passageway 137 which intersects the socket 172″. A catch 140 is disposed within the passageway 137 and a spring 138 biases the catch 140 toward the socket 172″. The catch 140 includes an elongate portion 142 for movement within the passageway 137 and a handle portion 144. The elongate portion 142 contacts the surface of the ball 174″.

OPERATION

In the collapsed position, the catch 140 is contacting the outer surface of the ball 174″ and the ball is oriented such that the tab 182″ is within the groove 175″. As the rail section 162″ is pivoted, the ball 174″ rotates and the tab 182″ slides in the groove 175″, until the tab is substantially colinear with the rail section. Referring to FIG. 15, the rail section 162″ (and ball 174″) are then rotated about the longitudinal axis of the rail section 162″. As rotation occurs, the elongate portion 142 of the catch 140 which is urged against the periphery of the ball 174″ continues to contact the ball. Rotation continues until the groove 175″ aligns with the passageway 137, and the elongate portion 142 of the catch 140 is driven into the groove 175″ by the spring bias. Pivoting of the rail section 162″ about its terminal end, is precluded by cooperation of the tab 182″ and the groove 175,″ rotation of the rail section about its longitudinal axis is precluded by engagement of the catch 140 and the groove 175″.

To collapse the playpen, the handle portion 144 is used to pull the elongate portion 142 from within the groove 175″. Once the catch 140 is withdrawn from the groove 175″, the rail section 162″ is rotated about its longitudinal axis until the tab 182″ is aligned with the groove 175″ to permit pivoting of the rail section about its terminal end.

Alternatively, the collapsible uprights 80 of the upright frame 70 of each end assembly may include a one way safety hinge. The safety hinge is similar to the action of the central coupler 166. That is, the one way safety hinge precludes articulation or collapsing of the upright 80 when the safety hinge is in the operative position. In the upright 80 employing the safety hinge, the lower end of the lower section 84 includes a radial slot. The radial slot extends approximately 90° of the periphery of the lower section. Similarly, the upper end of the upper section 82 includes a radial slot. The hinge 88 connects the upper section 82 to the lower section 84.

The upper end of the upper section 82 is received within a depending portion of the crossbar 110. A screw or similar pin is passed through the crossbar to project into the radial slot 83. The screw retains the upper section 82 relative to the crossbar 110, while permitting rotation of the upper section about is longitudinal axis. Similarly, the lower end of the lower section 84 is received within the end base 50. A screw or similar aim is passed through the end base to project into the radial slot. As the screw passes into the radial slot, the screw retains the lower section 84 relative to the end base 50. The hinge 88 defines an elongate U-shaped channel which receives the lower end of the upper section 82 and the upper end of the lower section 84.

When the closed portion of the safety hinge faces toward the opposing end assembly, the upper section may pivot about the safety hinge and away from the opposing end assembly. In the operative position, the closed portion of the hinge is rotated towards the near side of the playpen so that the open portion of the hinges within each end assembly face each other. Therefore, in the operative position, the hinges provide that the upper sections 82 within each upright may only rotate toward each other, however, as each upper section is affixed to the upper cross bar 110, which has a fixed length, the uprights are effectively locked into the operative position. To close the playpen the hinges are rotated to permit folding of the upper and lower portions as previously described.

While a preferred embodiment of the invention has been shown and described with particularity, it will be appreciated that various changes and modifications may suggest themselves to one having downward direction toward a center vertical leg located at each end and the side portions are pivotal inward bringing the two folded end portions together, to thereby fold the playpen.

What is claimed is:

1. A collapsible playpen moveable between a collapsed position and an operative position, comprising:

(a) a first end assembly and a second end assembly, each end assembly including an end base for contacting a supporting surface and an upper cross bar;

(b) articulated uprights extending between the end base and the upper cross bar in each end assembly for selectively separating the upper cross bars by a distance greater than the distance between the end bases, the articulated uprights adapted to be substantially vertical in the operative position of the playpen;

(c) lower articulated rails extending between the end bases for disposing the end bases in a parallel spaced apart orientation in the operative position and a parallel adjacent orientation in the collapsed position; and (d) upper articulated rails extending between the upper cross bars for connecting the upper cross bars of the first and second end assembly;

the uprights and the upper and lower rails adapted to orient the upper cross bar and the end base of each end assembly in a spaced apart parallel orientation in the operative position, and an adjacent parallel orientation in the collapsed position wherein the distance between the upper cross bars is greater than the distance between the end bases in the collapsed position of the playpen.

2. The collapsible playpen of claim 1, wherein the articulated uprights includes a lower upright section affixed to the base, an upper upright section connected to the upper cross bar, and a hinge connecting the lower upright section to the upper upright section.

3. The collapsible playpen of claim 1, wherein the lower articulated rails comprise a first lower rail and a second lower rail, wherein each lower rail includes a first rail section connected to the first end base and a second rail section connected to the second end base, wherein each connection of the rail section to the end base is adapted to permit pivoting of the rail section relative to the base and rotation of the rail section about its longitudinal axis, and a hinge connecting the first rail section to the second rail section.

4. The collapsible playpen of claim 1, wherein the upper articulated rails comprise a first upper rail and a second upper rail, wherein each upper rail includes a first and a second outer segment, and an intermediate segment, wherein one end of each outer segment is pivotally connected to the upper cross bar and the remaining end of each outer segment is pivotally connected to the intermediate segment.

5. The collapsible playpen of claim 1, further comprising a locking mechanism for releasably retaining the playpen in the operative position.

6. The collapsible playpen of claim 5, wherein the locking mechanism includes a rotatable member in one end assembly and a biased catch in the lower articulated rail means, the rotatable member and catch adapted to cooperatively engage upon orientation of the playpen in the operative position.

7. The collapsible playpen of claim 1, one of said end bases being pivotally connected to one of said lower articulated rails by a ball and socket joint, said playpen farther comprising a locking mechanism for retaining the playpen in the operative position, said locking mechanism comprising a spring biased catch attached to the exterior surface of said socket joint, said catch having an elongate portion which is urged against the periphery of the ball, the ball having a peripheral groove for receiving the elongate portion of the catch upon alignment of the groove with the elongate portion to thereby prevent rotation of the lower articulated rail about the end base.

8. The collapsible playpen of claim 7, each said lower articulated side rails comprise first and second rail sections, each of said first rail sections being pivotally connected to a first of said end bases, each of said second rail sections being pivotally connected to a second of said end bases, said first and second rail sections of each articulated side rails being pivotally connected to one another by a central coupler, said groove becoming aligned with said elongate portion of said catch in response to the rotation of said lower articulated side rail after said playpen is oriented in said operative position, said central coupler extending downward to provide vertical support for said lower articulated side rails when said side rails are rotated to align said groove with said elongate portion.

9. A collapsible playpen movable between an upright operative position and a relatively compact collapsed position, comprising:

(a) first and second collapsible end assemblies, each end assembly including an end base for contacting a supporting surface, an upper cross bar, and an articulated upright extending between the cross bar and the end base, each upright having an upper portion and a lower portion, wherein at least one of the upper and the lower portions is substantially vertical in the operative position of the playpen;

(b) first and second articulated side rails extending between the upper cross bars; and (c) lower articulated rails for connecting the end bases;

the collapsible end frames, side rails and lower rails arranged so that the playpen can be collapsed by moving the end bases together and initially moving the upper cross bars away from each other so that the distance between the upper cross bars is greater than the distance between the end bases in the collapsed position of the playpen.

10. The collapsible playpen of claim 9, wherein the collapsible end assemblies, side rails and lower rails are adapted so that the playpen can be collapsed by moving the end bases together in a parallel orientation while concurrently rotating the upper cross bars so that the distance between the upper cross bars is greater than the distance between the end bases.

11. A collapsible playpen movable between a collapsed position and an operative position, the playpen defining an operative volume for occupancy, comprising:

(a) a first end assembly and a second end assembly, each end assembly including an end base for contacting a support surface and an upper cross bar, wherein the operative volume is intermediate of the end assemblies upon orientation of the playpen in the operative position;

(b) articulated uprights extending between the end base and the upper cross bar in each end assembly for positioning the upper cross bar relative to the end base in the collapsed position and the operative position, the uprights including a substantially vertical component in the operative position;

(c) articulated lower rails extending between the end bases for disposing the end bases in a spaced apart orientation in the operative position; and (d) articulated upper rails extending between the upper cross bars for connecting the first and the second end assembly;

the uprights and the upper and lower rails adapted to orient the upper cross bar and the end base of each end assembly in a spaced apart orientation in the operative position and an adjacent orientation in the collapsed position, wherein the distance between the upper cross bars is greater than the distance between the articulated uprights in the collapsed position of the playpen.

12. A collapsible playpen movable between a collapsed position and an operative position, the playpen defining an operative area for occupancy, comprising:

(a) a first collapsible end assembly having an upper end portion and a lower end portion and a second collapsible end assembly having an upper end portion and a lower end portion, wherein the operative area is intermediate the first end assembly and the second end assembly in the operative position of the playpen;

(b) first and second collapsible side rails extending between opposed upper end portions, the side rails separating the upper end portions by a first distance in the operative position of the playpen and a second shorter distance in the collapsed position for the playpen; and (c) lower articulated rails connecting the opposed lower end portions;

the collapsible end assemblies, side rails and lower rails arranged so that the playpen can be collapsed by moving the lower end portions towards each other and initially moving the upper end portions away from each other, such that the lower end portions are intermediate of corresponding portions of the opposed side rails in the collapsed position.

13. The collapsible playpen of claim 12, wherein the collapsible end assemblies side rails and lower rails are adapted so that the playpen can be collapsed by moving the lower end portions together in a parallel orientation while concurrently rotating the upper end portions so that the distance between the upper end portions is greater than the distance between the lower end portions in the collapsed position.

14. A collapsible playpen frame, the playpen frame movable between a folded position and a self supporting open position, comprising:

(a) a pair of end assemblies, each end assembly including an end base for contacting a support surface, an upper cross bar, and an articulated upright extending between each end base and the upper cross bar in each end assembly, each upright including a substantially vertical member in the open position of the playpen; and (b) articulated upper rails means extending between the end assemblies to interconnect the upper cross bar of one end assembly with the upper cross bar of the remaining end assembly;

the upper rails and the uprights movable from the self supporting open position to the folded position such that upon orientation of the playpen frame in the folded position at least a portion of each end assembly is intermediate of same side outer portions of the upper rails.

15. A collapsible playpen frame, the playpen frame movable between a folded position and a self supporting open position, comprising:

(a) a pair of end assemblies, each end assembly including an upper cross bar, an end base for contacting a support surface and an articulated upright assembly extending between each end base and the upper cross bar in each end assembly, each articulated upright assembly having an articulated section; and (b) upper rails extending between the end assemblies to interconnect the upper cross bars, each upper rail having an articulated portion wherein the articulated portion has a length substantially equal to the articulated section of each upright assembly;

the upper rails and the upright assemblies movable from the self supporting open position to the folded position such that upon orientation of the playpen frame in the folded position the articulated sections of the upright assembly are intermediate of the upper rail articulated portions.

16. A method for collapsing a foldable playpen having a pair of opposed end assemblies, each end frame having an upper cross bar, an end base for contacting a supporting surface, and an articulated upright extending between the end base and the upper cross bar for each end assembly, each upright having an upper portion and a lower portion, at least one of the upper and lower portions being substantially vertical in an operative position of the playpen, the lower portions connected by articulated lower rails, comprising:

(a) at least partially folding the lower rails to reduce the distance between the end bases;

(b) moving the upper cross bars in substantially opposite directions; and (c) folding each frame so that the upper portions of the uprights are intermediate of same side outer portions of the upper rail means.

17. The method of claim 16, further comprising:

(a) folding the lower rails to dispose the end assemblies in a parallel adjacent orientation; and (b) folding the end assemblies such that each upper cross bar is adjacent its respective end base, and the end bases are intermediate of the opposed upper cross bars.

18. The method of claim 16, one of said end bases being pivotally connected to said lower articulated rails by a ball and socket joint, said playpen further having a locking mechanism for retaining the playpen in the operative position, said locking mechanism comprising a spring biased catch attached to the exterior surface of said socket joint, said catch having an elongate portion which is urged against the periphery of the ball, the ball having a peripheral groove for receiving the elongate portion of the catch upon alignment of the groove with the elongate portion to thereby prevent rotation of the lower articulated rail about the end base, said method further comprising the steps of:

disengaging the locking mechanism to allow rotation of the lower articulated rail about the end bases; and rotating the lower articulated rail to allow the folding of the lower articulated rail.

19. A method of collapsing a foldable playpen having a pair of end assemblies, each end assembly including a lower end portion and an upper end portion, each upper end portion including an upper cross bar, each lower end portion including an end base, the lower portions connected by articulated lower rails and the upper end portions connected by articulated upper rails, the lower end portion and upper end portion of each end assembly being pivotally connected, comprising:

(a) decreasing the distance between the lower end portions; and (b) decreasing the distance between the upper cross bars of the end frames, such that the distance between the lower end portions decreases more than the distance between the upper end portions, and the lower end portions are intermediate the upper end portions.

20. The method of claim 19, further comprising decreasing the distance between the lower end portions to position the lower end portions substantially adjacent each other, and orienting the upper end portions adjacent the corresponding lower end portions such that the lower end portions are substantially intermediate of the upper end portions.

21. A method of collapsing a foldable playpen having a pair of collapsible end assemblies, each end assembly including a lower end portion and an upper end portion connected by a joint, the lower end portions connected to each other by lower articulated rails, comprising:

(a) at least partially folding the lower rails to reduce the distance between the lower end portions; and (b) folding each upper end portion relative to the lower end portion so that the upper end portions are separated by a distance greater than the distance between the lower end portions.

22. The method of claim 21, further comprising:

(c) folding the lower articulated rails to dispose the lower end portions in a parallel adjacent orientation.

23. A method of collapsing a foldable playpen from an open position to a collapsed position, the playpen having a pair of parallel end assemblies, each end assembly including an articulated upper and lower end portion, the upper end portion including an upper cross bar, the lower end portion including an end base, the lower end portions connected by articulated lower rails and the upper end portions connected by articulated upper rails, comprising:

(a) substantially simultaneously decreasing the distance between the parallel lower end portions and upper end portions, such that the distance between the lower end portions decreases more than the distance between the upper end portions.

24. The method of claim 23, further comprising:

(b) decreasing the distance between the lower end portions to position the end bases substantially adjacent each other; and (c) orienting the upper cross bars adjacent the corresponding end bases such that the end bases are substantially intermediate of the upper cross bars.

25. A collapsible playpen movable between a collapsed position and an operative position, the playpen defining an operative volume for occupancy, comprising:

(a) a first end assembly and a second end assembly, each end assembly including an end base for contacting a support surface, an upper cross bar, and articulated uprights extending at each corner of the playpen between the end base and the upper cross bar for positioning the upper cross bar relative to the end base in the collapsed position and the operative position, wherein the operative volume is intermediate of the end assemblies upon orientation of the playpen in the operative position, each upright including an upper portion fixedly attached to an upper cross bar, and a lower portion fixedly attached to an end base, the upper and lower portions of each upright being connected to each other by a hinge and being substantially vertical in the operative position;

(b) articulated lower rails extending between the end bases for disposing the end bases in a spaced apart orientation in the operative position, each lower rail includes two rail sections and a central coupler, at least one of said rail sections being connected to an end base via a ball and socket joint, the two rail sections of each lower rail being pivotally connected to each other via said central coupler; and (c) articulated upper rails extending between the upper cross bars for connecting the first and the second end assembly, each articulated upper rail including two outer segments and an intermediate segment pivotally connected to said outer segments, each upper rail outer segment being pivotally attached to an upper cross bar and an upper portion of an upright; and (d) the uprights and the upper and lower rails adapted to orient the upper cross bar and the end base of each end assembly in a spaced apart orientation in the operative position and an adjacent orientation in the collapsed position, wherein the distance between the upper cross bars is greater than the distance between the end bases in the collapsed position of the playpen.

26. The collapsible playpen of claim 25 further comprising a locking mechanism for releasably retaining the playpen in the operative position, said locking mechanism comprising a spring biased catch attached to the exterior surface of said socket joint, said catch having an elongate portion which is urged against the periphery of the ball, the ball having a peripheral groove for receiving the elongate portion of the catch upon alignment of the groove with the elongate portion to thereby prevent rotation of the lower articulated rail means about the end base.

* * * * *